US005755395A

United States Patent [19]

Gnan

[11] Patent Number: 5,755,395

[45] Date of Patent: May 26, 1998

[54] PAPER ROLL CONVEYING AND ORIENTING SYSTEMS FOR PAPER PROCESSING UNWINDING SYSTEMS

[75] Inventor: Alfons Josef Gnan, Vilseck, Germany

[73] Assignee: BHS Corrugated Maschinen-und Anlagenau GmbH, Weiherhammer, Germany

[21] Appl. No.: 524,689

[22] Filed: Sep. 7, 1995

[30] Foreign Application Priority Data

Sep. 9, 1994 [DE] Germany ..... 94 14 677 U

[51] Int. Cl.[6] ..... B65H 19/12

[52] U.S. Cl. ..... 242/559.1; 242/559.4; 198/345.2; 414/911

[58] Field of Search ..... 242/559, 559.1, 242/559.3, 559.4, 561; 414/911; 198/345.2, 345.3

[56] References Cited

U.S. PATENT DOCUMENTS

| | | | |
|---|---|---|---|
| 2,281,423 | 4/1942 | Egge | 242/559 |
| 4,131,206 | 12/1978 | Kawada et al. | 242/559.4 |
| 4,682,743 | 7/1987 | Tokuno et al. | 242/559 |
| 5,238,352 | 8/1993 | Abe et al. . | |

FOREIGN PATENT DOCUMENTS

| | | |
|---|---|---|
| 0391061 | 10/1990 | European Pat. Off. . |
| 2613340 | 10/1988 | France . |
| 2631355 | 1/1978 | Germany . |
| 4207199 | 9/1992 | Germany . |

OTHER PUBLICATIONS

Patent Abstracts Of Japan, vol. 005, No. 135, Aug. 26, 1981.

*Primary Examiner*—John M. Jillions
*Attorney, Agent, or Firm*—Browdy and Neimark

[57] ABSTRACT

A paper roll conveying and orienting system for a paper processing unwinding system comprises a conveyor which is displaceable in a conveying direction extending parallel to a receiving axis. A loading plate for receiving a paper roll is arranged on the conveyor. The loading plate is disposed displaceably in a horizontal plane transversely to the receiving axis and/or pivotally round a vertical pivot axis. The unwinding system is allocated an orienting device which can be brought into engagement with the loading plate in its position before the unwinding system. The orienting device has at least one drive for displacing the loading plate transversely to the pivot axis and/or for pivoting the loading plate round the vertical pivot axis.

10 Claims, 2 Drawing Sheets

6
a
5
7
2
4
3
8
9
20
32
36
16
10
15
13
1

8
6
24
26
25
16
17
23
22
30
31
34
32
18
29
18
14
21
15
20
13
1

PAPER ROLL CONVEYING AND ORIENTING SYSTEMS FOR PAPER PROCESSING UNWINDING SYSTEMS

FIELD OF THE INVENTION

This invention relates to paper roll conveying and orienting systems for paper processing unwinding systems.

BACKGROUND OF THE INVENTION

Unwinding systems for rolls of paper normally used in paper processing machinery, for example corrugated cardboard machinery, are designed as unwinding stands for receiving two rolls of paper. They have two pivot arm mechanisms which are arranged symmetrically to one another and each have a pair of pivot arms mounted on a pivot shaft. These pairs of pivot arms can be pivoted upwardly and downwardly around their horizontal pivot shaft in order to receive, from a conveyor, a roll of paper which can have widely varying diameters, for example from 0.3 to 1.5 m. As the pairs of pivot arms are pivoted round a shaft, different horizontal gaps between the axis of the roll receiving device of the pivot arm pairs and the axis of the paper rolls are produced with different paper roll diameters. Furthermore, a roll of paper of this type does not generally lie parallel to the axis of the paper roll receiver.

To solve these problems, it is already known to provide a stop which is coupled to the pivot arm mechanisms and guides a stop against the roll of paper when the pivot arms are pivoted into a position for receiving the roll of paper. An orienting drive which acts on the roll and presses it against the stop is provided on the opposite side. A drawback of this known solution is that the orienting drive has to act in the central region of the roll of paper as rolls of paper having widely varying lengths are used. This leads to orientation errors, in particular in the case of long rolls. There is also the risk that the paper will be damaged owing to the necessarily high orientation forces by means of the orienting drive.

SUMMARY OF THE INVENTION

The object of the invention is to design a paper roll conveying and orienting system of the generic type so as to allow reliable orientation of the roll of paper before the paper processing unwinding system, without the risk of damaging the roll of paper.

According to one aspect of the invention, there is provided a paper roll conveying and orienting system for a paper processing unwinding system comprising:

- a conveyor which is diplaceable in a conveying direction extending parallel to a receiving axis;
- a loading plate displaceably disposed on the conveyor in a horizontal plane extending transversely to the receiving axis for receiving a paper roll; and
- an orienting device which is allocated to said unwinding system and which is adapted to be brought into engagement with the loading plate in its position before the unwinding system, said orienting device having at least one drive for displacing the loading plate transversely to the pivot axis.

Another aspect of the invention provides a paper roll conveying and orienting system for a paper processing unwinding system comprising:

- a conveyor which is diplaceable in a conveying direction extending parallel to a receiving axis;
- a loading plate pivotally mounted around a vertical pivot shaft; and

- an orienting device which is allocated to said unwinding system and which is adapted to be brought into engagement with the loading plate in its position before the unwinding system, said orienting device having at least one drive for pivoting the loading plate around the said vertical pivot shaft.

The essence of the invention is that the loading plate of the conveyor is oriented before the unwinding system, more specifically primarily by displacement of the loading plate in the horizontal plane transversely to the direction of the axis of the receiving device of the unwinding system. The horizontal gaps between the paper roll axis and the receiving axis of the roll receiving device caused by different paper roll diameters and mentioned at the outset are compensated in this way. As a secondary feature, alignment errors between the paper roll axis and the receiving device axis which may be caused by oblique positions of the roll of paper on the loading plate can also be compensated by pivoting the loading plate round a vertical pivot axis.

A slot connection extending transversely to the receiving axis may be provided between the leading plate and the conveyor. The slot connection desirably has two slots which are penetrated by respective bolts, one of said slots having a dimension in the conveying direction which is considerably greater than the diameter of the bolt.

Preferably the conveyor has a carriage carrying the loading plate and catch devices securing a neutral position between said loading plate and carriage are provided.

According to a preferred embodiment of the invention, the orienting device has an orienting member which is adapted to be brought into positive engagement with the loading plate and is displaceable in a horizontal plane transversely to the receiving axis by means of two linear drives spaced from one another in the said conveying direction. The orienting member may also be pivotal about an axis extending transversely to the said receiving axis.

The orienting member is preferably provided with at least one projection which engages in a recess in the loading plate and the said recess may take the form of a continous groove, extending in the said conveying direction, on the underside of the loading plate. The projection may be designed as an orienting rail projecting upwardly from the orienting member.

BRIEF DESCRIPTION OF THE DRAWINGS

The invention will now be described in detail, by way of example, with reference to the drawings, in which.

DESCRIPTION OF PREFERRED EMBODIMENT

Figure 1:
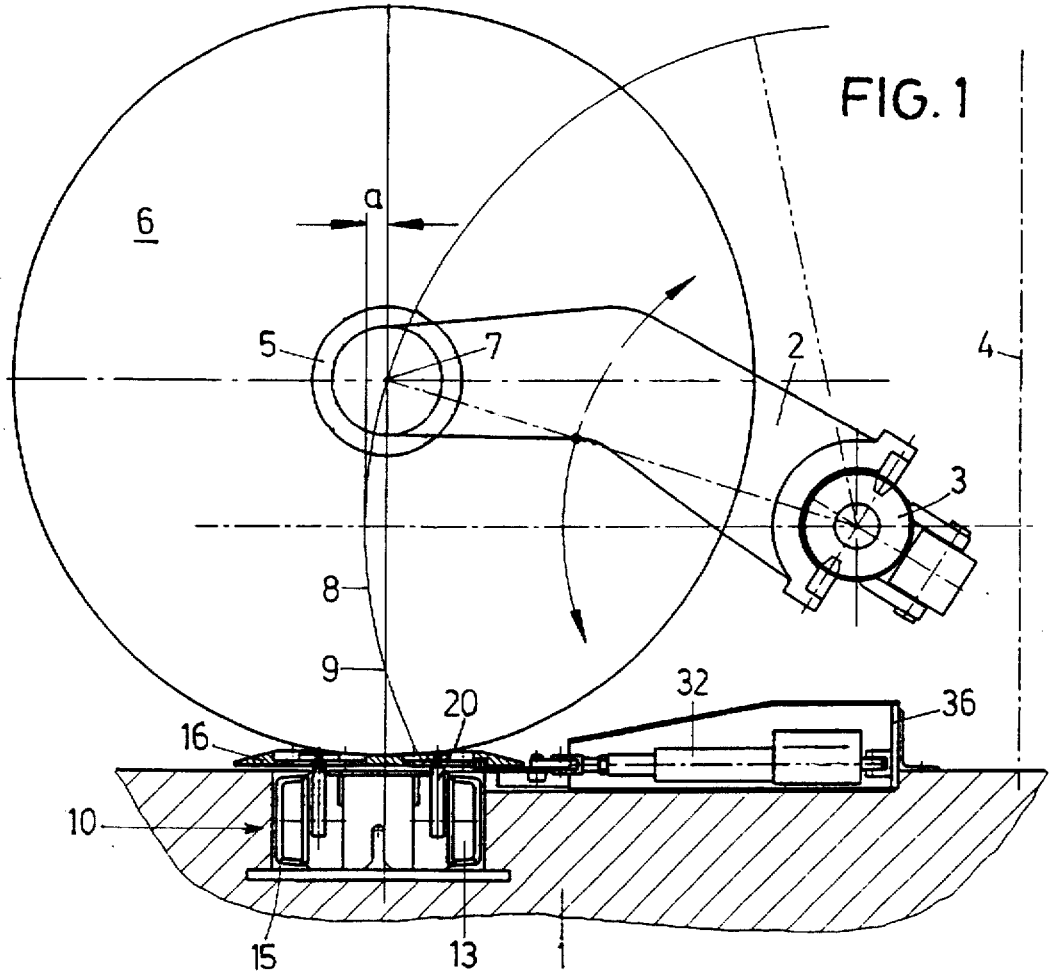
FIG. 1 is a side view of a paper processing unwinding system with a paper roll conveying and orienting system according to one embodiment of the present invention.
Figure 3:
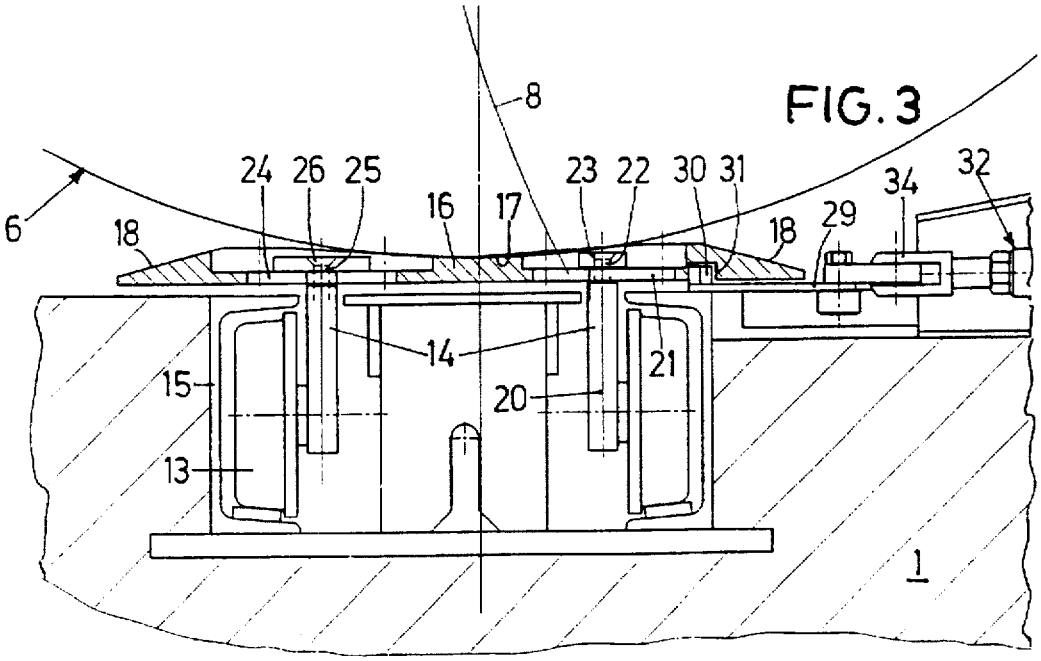
FIG. 3 shows a partial detail from FIG. 1 to an enlarged scale.
Figure 2:
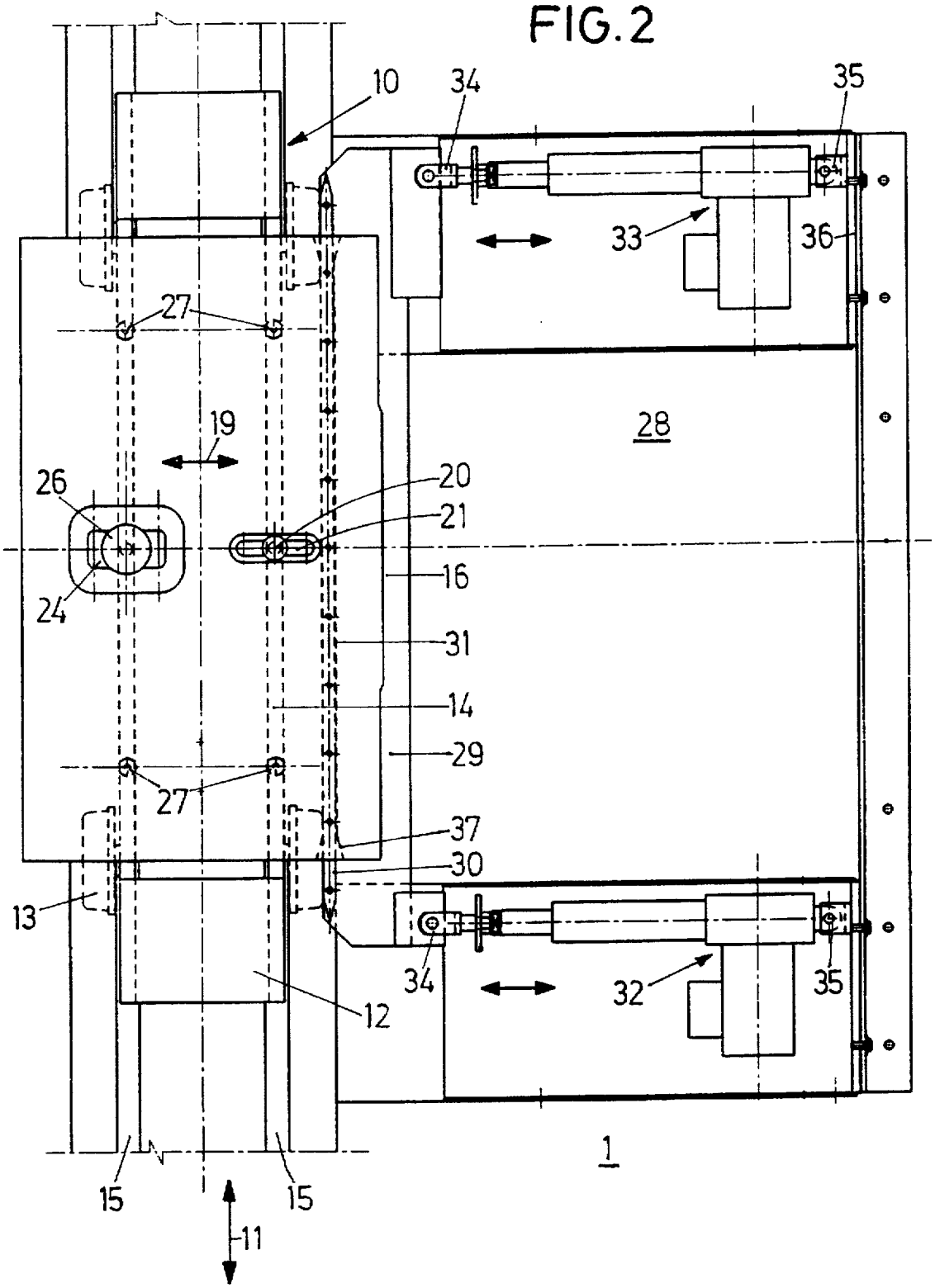
FIG. 2 is a plan view of the paper roll conveying and orienting system shown in FIG. 1.

Refering to the drawings, a paper processing unwinding system which is stationary relative to the ground 1 has a pair of pivot arms 2 which are pivotal around a horizontal shaft 3. Two such paper processing unwinding systems are usually provided symmetrically to a plane of symmetry 4 indicated in dot-dash lines. The pivot arms 2 have, at their free ends, a respective receiving device 5 capable of engaging in a central roll tube of a paper roll 6 in order to receive this roll and to pivot it upwardly. The receiving devices 5 have a common receiving axis 7 which is parallel to the shaft 3 and is to coincide with the axis of the paper roll 6 during and after receiving. The receiving axis 7 is pivotal around the shaft 3 over a portion of an arc 8 shown in solid lines. The position of the pivot arms 2 for a paper roll 6 of maximum diameter is shown in the drawings. A position of the receiving axis 7 with a minimum diameter of the paper roll 6 is marked by 9. The shaft 3 is arranged in such a way that it is located in the vertical centre between the position 9 and the highest position of the receiving axis 7 shown in the drawing. During a pivoting movement from the illustrated position into position 9, the receiving axis 7 travels horizontally over a path a which can be about 50 mm in practice.

The paper roll 6 is conveyed on a conveyor 10 of which the conveying direction 11 extends horizontally and parallel to the receiving axis 7. It is a so-called underfloor conveyor with a carriage 12 of which the wheels 13 are mounted on a frame 14 and run in U-shaped rails 15 arranged in the ground 1. On the frame 14 there is disposed a loading plate 16 which is arranged directly above the ground 1. The loading plate 16 has a partially cylindrical loading surface 17 which is curved slightly downwardly and of which the surface lines extend parallel to the receiving axis 7 of the receiving device 5. Ramp faces 18 extend from the lateral edges of the loading surface 17 and fall toward the ground 1. In the direction of the receiving axis 7 offset laterally relative to the paper processing unwinding system, a paper roll 6 is placed on the loading plate 16 of the conveyor 10 and the loading plate 16 is then moved together with the paper roll 6 in the conveying direction 11 between the pivot arms 2 of the unwinding system where the paper roll 6 is gripped by the receiving devices 5 and pivoted upwardly by means of the pivot arms 2. The paper processing unwinding system and the conveyor 10 as described hitherto are known and are commonly used in practice.

The loading plate 16 is horizontally displaceable on the frame 14 of the carriage 12 in direction 19 transversely to the conveying direction 11 and transversely to the direction of the receiving axis 7. The loading plate 16 is also pivotal round a vertical pivot axis 20. To permit these functions, a slot 21 parallel to the direction 19 is formed in the loading plate 16. It is penetrated by a bolt 22, forming the pivot axis 20, with head 23. A further slot 24 is formed in the loading plate 16 and is also penetrated by a bolt 25 connected to the carriage 12 and having a head 26. Although the width of the slot 21 is only slightly greater than the diameter of the bolt 22, the width of the slot 24 in the conveying direction 11 is much greater than the diameter of the bolt 25, so the loading plate 16 can also be displaced in the conveying direction 11 in the region of this slot 24. As it is simultaneously held in the slot 21—with respect to the conveying direction 11—it can be pivoted round the bolt 22 forming the pivot axis 20, more specifically in the region of the slot 24, by an amount in the direction of the conveying direction 11 representing about ±50 mm in practical cases. The bolts 22 and 25 are fastened on the frame 14 of the carriage 12.

The loading plate 16 is held on the frame 14 of the carriage 12 in its neutral starting position relative to the carriage 12 by frictional forces by means of four catch systems 27, so an unintentional change in the position of the loading plate 16 relative to the carriage 12 is prevented. Such catch systems 27 can consist of spring-loaded balls which engage in corresponding recesses on the underside of the loading plate 16 and are pressed into them. During a displacement of the loading plate 16, they are pressed from this recess in the underside of the loading plate 16 against the force of the spring and against additional frictional forces.

An orienting device 28 is disposed on the ground 1 before the paper processing unwinding system, more specifically below and substantially between the pivot arms 2. It has an elongate orienting member 29 on which an orienting rail 30 extending substantially in the conveying direction 11 is disposed. This rail engages with a groove-like recess 31 formed on the underside of the loading plate 16 when the conveyor 10 is driven before the unwinding system.

At the two outer ends of the orienting member 29, which are spaced in the conveying direction 11, two, for example electromechanical, linear drives 32, 33 act thereon, the linear drives 32, 33 being connected on the one hand to the orienting member 29 by means of joints 34 and on the other hand to stationary abutments 36 by means of joints 35 so the linear drives 32, 33 can be pivoted round vertical pivot axes in the joints 34, 35.

The orienting rail 30 is displaced parallel to itself in direction 19 by a uniform drive of the linear drives 32, 33, i.e. the loading plate 16 positively connected thereto with a paper roll 6 is displaced in the same manner.

If the loading plate 16 is to be pivoted round the pivot axis 20 with the paper roll 6, the two linear drives 32, 33 are driven differently so the orienting rail 30 performs a pivoting movement which is transmitted onto the loading plate 16. If relative movements occur between the orienting rail 30 and the loading plate 16 in conveying direction 11, they are not prevented because there is a positive connection only in direction 19 between the orienting rail 30 and the loading plate 16.

The linear drives 32, 33 can be freed when the carriage 12 approaches and moves away, allowing non-jamming approach and removal of the loading plate 16 from the orienting rail 30. Introduction is also simplified in that the recess 30 has widening entry surfaces 37 at its ends.

When a paper roll 6 is placed on the loading plate, 16, the loading plate 16 is located in its above-mentioned neutral position relative to the carriage 12, in which the four catch systems 27 engage in the underside of the loading plate 16. During introduction of the carriage 12 with the paper roll 6 into the position between the pivot arms 2, the loading plate 16 therefore invariably has an exactly defined position relative to the orienting device 28. Problem-free entry of the orienting rail 30 into the recess 31 is therefore guaranteed. The loading plate 16 with the paper roll 6 is only aligned afterwards. When the paper roll 6 is lifted from the loading plate 16, the loading plate 16 is brought back, by appropriate drive of the linear drives 32, 33, into its neutral position in which the catch systems 27 engage in the loading plate 16. The carriage 12 is only then brought back into the loading position.

The invention is not restricted to the above-described embodiment but variations and modifications may be made without departing from the spirit and scope of the invention as defined by the appended claims.

I claim:

1. A paper roll conveying and orienting system for a paper processing unwinding system comprising:

a conveyor which is displaceable in a conveying direction extending parallel to a receiving axis;

a loading plate, for receiving a paper roll, disposed on the conveyor and movable relative to the conveyor by displacing in a horizontal direction extending transversely to the receiving axis and by pivoting around a vertical pivot axis; and an orienting device which is allocated to said unwinding system and which is adapted to be brought into engagement with the loading plate in its position before the unwinding system, said orienting device having at least one drive for displacing the loading plate transversely to the pivot axis and pivoting the loading plate around the vertical pivot axis.

2. A paper roll conveying and orienting system for a paper processing unwinding system comprising:

a conveyor which is displaceable in a conveying direction extending parallel to a receiving axis, a loading plate, for receiving a paper roll, disposed on the conveyor and movable relative to the conveyor by at least one of displacement in a horizontal plane extending transversely to the receiving axis and pivoting around a vertical pivot axis; and an orienting device which is allocated to said unwinding system and which is adapted to be brought into engagement with the loading plate in its position before the unwinding system, said orienting device having at least one drive for at least one of displacing the loading plate transversely to the pivot axis and pivoting the loading plate around the vertical pivot axis;

in which a slot connection extending transversely to the receiving axis is provided between the loading plate and the conveyor.

3. A system as claimed in claim 2, in which the slot connection has two slots which are penetrated by respective bolts, one of said slots having a dimension in the conveying direction which is considerably greater than the diameter of the bolt.

4. A paper roll conveying and orienting system for a paper processing unwinding system comprising:

a conveyor which is displaceable in a conveying direction extending parallel to a receiving axis;

a loading plate, for receiving a paper roll, disposed on the conveyor and movable relative to the conveyor by at least one of displacement in a horizontal plane extending transversely to the receiving axis and pivoting around a vertical pivot axis; and an orienting device which is allocated to said unwinding system and which is adapted to be brought into engagement with the loading plate in its position before the unwinding system, said orienting device having at least one drive for at least one of displacing the loading plate transversely to the pivot axis and pivoting the loading plate around the vertical pivot axis;

in which the conveyor has a carriage carrying the loading plate and in which catch devices securing a neutral position between said loading plate and carriage are provided.

5. A paper roll conveying and orienting system for a paper processing unwinding system comprising:

a conveyor which is displaceable in a conveying direction extending parallel to a receiving axis;

a loading plate, for receiving a paper roll, disposed on the conveyor and movable relative to the conveyor by at least one of displacement in a horizontal plane extending transversely to the receiving axis and pivoting around a vertical pivot axis; and an orienting device which is allocated to said unwinding system and which is adapted to be brought into engagement with the loading plate in its position before the unwinding system, said orienting device having at least one drive for at least one of displacing the loading plate transversely to the pivot axis and pivoting the loading plate around the vertical pivot axis;

in which the orienting device has an orienting member which is adapted to be brought into positive engagement with the loading plate and is displaceable in a horizontal plane transversely to the receiving axis by means of two linear drives spaced from one another in said conveying direction.

6. A system as claimed in claim 5, in which the orienting member is pivotal about an axis extending transversely to the said receiving axis.

7. A system as claimed in claim 5, in which the orienting member is provided with at least one projection which engages in a recess in the loading plate.

8. A system as claimed in claim 7, in which the recess takes the form of a continuous groove, extending in the said conveying direction, on the underside of the loading plate.

9. A system as claimed in claim 7, in which the projection is designed as an orienting rail projecting upwardly from the orienting member.

10. A paper roll conveying and orienting system for a paper processing unwinding system comprising:

a conveyor which is displaceable in a conveying direction extending parallel to a receiving axis;

a loading plate, for receiving a paper roll, disposed on the conveyor and movable relative to the conveyor by at least one of displacement in a horizontal plane extending transversely to the receiving axis and pivoting around a vertical pivot axis; and an orienting device which is allocated to said unwinding system and which is adapted to be brought into engagement with the loading plate in its position before the unwinding system, said orienting device having at least one drive for at least one of displacing the loading plate transversely to the pivot axis and pivoting the loading plate around the vertical pivot axis;

in which the orienting device has an orienting member which is adapted to be brought into positive engagement with the loading plate and is pivotal about an axis extending transversely to the receiving axis.

* * * * *